US011352794B2

(12) United States Patent
Anthony

(10) Patent No.: US 11,352,794 B2
(45) Date of Patent: Jun. 7, 2022

(54) EDGE FLASHING FOR FLAT ROOF WITH FUNCTIONAL SURFACE MATERIAL

(71) Applicant: Eli Anthony, Minneapolis, MN (US)

(72) Inventor: Eli Anthony, Minneapolis, MN (US)

( * ) Notice: Subject to any disclaimer, the term of this patent is extended or adjusted under 35 U.S.C. 154(b) by 0 days.

(21) Appl. No.: 16/847,586

(22) Filed: Apr. 13, 2020

(65) Prior Publication Data

US 2020/0325686 A1 Oct. 15, 2020

Related U.S. Application Data

(60) Provisional application No. 62/833,173, filed on Apr. 12, 2019.

(51) Int. Cl.
*E04D 13/076* (2006.01)
*E04D 13/064* (2006.01)

(52) U.S. Cl.
CPC ..... *E04D 13/076* (2013.01); *E04D 13/064* (2013.01)

(58) Field of Classification Search
CPC ..... E04D 13/076; E04D 13/064; E04D 2013/0468; E04D 2013/0472; E04D 13/0459; E04D 13/0725
See application file for complete search history.

(56) References Cited

U.S. PATENT DOCUMENTS

| | | | | |
|---|---|---|---|---|
| 5,862,631 | A * | 1/1999 | Attaway | E04D 13/158 52/11 |
| 2003/0159379 | A1* | 8/2003 | Pickler | E04D 13/15 52/283 |
| 2008/0010906 | A1* | 1/2008 | Brochu | E04D 13/076 52/12 |
| 2008/0127575 | A1* | 6/2008 | Ealer | E04D 13/076 52/12 |
| 2009/0056234 | A1* | 3/2009 | Brochu | E04D 13/076 52/12 |
| 2011/0056145 | A1* | 3/2011 | Lenney | E04D 13/076 52/12 |
| 2013/0055651 | A1* | 3/2013 | Garcia | E04F 19/061 52/58 |
| 2013/0276380 | A1* | 10/2013 | Adams | E04D 13/076 52/12 |
| 2015/0225959 | A1* | 8/2015 | Lenney | E04D 13/064 52/12 |
| 2017/0145697 | A1* | 5/2017 | Anthony | E04D 13/15 |
| 2018/0216348 | A1* | 8/2018 | Morris | F16B 2/243 |
| 2018/0283009 | A1* | 10/2018 | Stacye | E04D 13/0725 |
| 2018/0347197 | A1* | 12/2018 | Folkersen | E04D 13/1585 |
| 2018/0347199 | A1* | 12/2018 | Folkersen | E04D 13/158 |
| 2019/0218782 | A1* | 7/2019 | Miller, Jr. | E04D 13/076 |
| 2020/0240147 | A1* | 7/2020 | Adams | E04D 13/064 |

* cited by examiner

*Primary Examiner* — Theodore V Adamos
(74) *Attorney, Agent, or Firm* — Patterson Thuente Pedersen, PA

(57) ABSTRACT

Various types of flashing for use at the edge of flat roofs, decking or green roofs are presented. In exemplary embodiments, flashing may be provided at the edge of a roof to retain or provide an edge treatment for an aesthetic and functional surface material, such as, for example, a cast paver, while at the same time allowing for water drainage.

4 Claims, 17 Drawing Sheets

EDGE FLASHING FOR FLAT ROOF WITH FUNCTIONAL SURFACE MATERIAL

CROSS-REFERENCE TO RELATED APPLICATIONS

The present application claims the benefit of U.S. Provisional Application No. 62/833,173 filed on Apr. 12, 2019, the disclosure or which is hereby incorporated herein by reference as if fully set forth.

BACKGROUND—FIELD

This application relates to flashing used at the edge of flat roofs to retain or edge an aesthetic and functional surface material such as a cast paver, while at the same time allowing for water drainage.

BACKGROUND—PRIOR ART

Most commonly when a relatively flat roof is going to be used as a functional balcony or terrace, there is material that is installed over the waterproofing membrane/roofing both for aesthetic and practical reasons. An example of this might be a wood deck with non-penetrating framing (sleepers). Another example would be a cast paver (such as a split brick paver). Another surface material would be an exterior tile (usually at least ¾" thick). Another material would be stone pavers.

Such surface material extends the life of the waterproofing membrane or roofing by protecting it from foot traffic as well as from the elements. Such surface material can also weigh down the waterproofing membrane thus helping to ensure that over time it is less likely to pull away from substrate, especially around the edges.

Water is likely to penetrate installed surface material. If a roof has a pitch (IRC=¼ per foot=minimum pitch required) directed towards one or more of the edges, rainwater will end up towards these edges.

Sometimes in such cases, the roofing membrane is adhered down the outside vertical surface of the perimeter fascia. The roofing membrane may also overlap and deposit water into a gutter. Often this technique exposes the full outside edge of the installed surface material as well as the vertical leg of the roofing membrane that overlaps the fascia. In such instances, the roofing membrane may solely rely on an adhesive to remain attached to the vertical outside face of the fascia. An alternative that may be desirable both for aesthetic and structural purposes would be the utilization of an installed edging flashing.

Such an edging flashing can act to retain the installed surface material which can in turn weigh down the perimeter of the roofing membrane helping it to stay adhered. This edging flashing can also hide the lower outside perimeter edge of the surface material, any substructure for the surface material or drainage material, and the roofing membrane. Some may consider this utilization of an edging flashing to be more aesthetically pleasing.

It is important to allow for drainage when installing an edging flashing that rises higher than the surface of the top of the membrane in order to border/retain/edge an installed surface material. If the roof is pitched towards one or more of the roof edges, water must be directed out and away from the roof, into a water collection device such as a gutter.

Within the prior art there are many devices used to edge the perimeter of a roof and retain a surface material. These devices, however, do not allow for water drainage if water were to get under the installed surface material. Attention is drawn to U.S. Pat. Nos. 3,389,515, 3,432,976, 4,780,999, 5,927,023, Germany EP 1970499. Such devices can be of service if drainage occurs somewhere within the roof area and the roof is pitched towards that drain. However, when the pitch of the roof directs water towards the outer edges, ponding will occur if the edging system does not allow for the water to pass.

Other devices utilize holes in the vertical edging in order to manage water. An example of such a device is U.S. Pat. No. 5,414,965. If a surface material abuts into such a vertical edge, the holes may be partially or completely blocked so that the water may be slow to release and ponding could occur.

Such edging as U.S. Pat. No. 5,414,965 may also not account for a variance of pressure applied by the surface material. Often a roof surface is not perfectly square. In such instances, the installed surface material may have to be cut at a slight angle or the surface material may push at different pressures along the edging. In this case, it would be a benefit to have some flex range in the edging product that helps take into account this variation in layout. If the vertical edging surface in U.S. Pat. No. 5,414,965 (FIG. 9) is pressed out by the abutment of an installed surface material, a gap may start to open up between the top of the edging and the surface material. Such a gap could collect debris over time and become less aesthetically pleasing. Also, the edging referenced may become noticeably pitched if pressed out by the abutting surface material.

Another example of a one-piece flashing that is used as an edging on a flat roof is U.S. Pat. No. 8,739,470. In this example, the roofing which may include an installed surface material is clamped down by the top outer leg of the flashing. One challenge of the U.S. Pat. No. 8,739,490 flashing is that there are many different thicknesses of surface material. The flashing would need to come in many sizes to accommodate the varying thicknesses of available material, or be bent (or un-bent) to accommodate different sizes. Also, if the desired surface material to be installed is not of consistent thickness, gaps under the irregular leg of flashing could collect debris. Also the top leg of the flashing that comes over the surface material may also need to be adjusted or cut if the posts for the guardrail are installed close to the roof edge. (The International Building Code requires decks, terraces, and balconies to have a guardrail if they are of a height greater than 32" off of the ground).

SUMMARY

A number of variations of Perimeter retaining edge flashing are presented in this application.

The variations consist of a two-part flashing that serves as a perimeter retaining edging for pavers and also allows for water to flow out and away from the roof. Part one provides a trough for water to travel. Part two being perforated so that water can pass through.

Advantages of Proposed Flashing

The flashing serves as an edging providing support for applied surface material which in turn provides protection for a roofing membrane. A leg of the flashing is installed under an applied surface material thus augmenting the solidity and longevity of the installation. At the same time the flashing manages water away from the building structure.

The flashing can be installed under the roofing membrane using mechanical fasteners, construction adhesive, etc., or it can be installed over the roofing membrane using an adhesive flashing tape (marginal strip that is compatible with roofing membrane) that overlaps the flashing and the roofing membrane.

The flashing can have a degree of flexibility as edging, making the installation of surface material easier and more aesthetically pleasing. This flexibility is especially important when the roof is not perfectly square in relation to the installed surface material.

The flashing creates an aesthetically pleasing edge that harmonizes with architecture. The flashing hides the under structure, roofing membrane, any drainage mat or material or slip sheet, and the lower edge of the installed surface material.

The flashing lends itself to ease of manufacturing and installation. It can easily be fabricated out of sheet metal. During installation there is reasonable space to work inside the trough to both rivet and apply sealant to miters and joints.

DETAILED DESCRIPTION OF THE INVENTION

Various exemplary embodiments of novel types of flashing are described. In exemplary embodiments of the present invention, the flashing can serve as an edging, providing support for an applied surface material on a roof, which in turn provides protection for a roofing membrane. A horizontal (or pitched parallel to the pitch of the underlying roof) leg of the novel flashing can be installed under such an applied surface material, for example, thus augmenting the solidity and longevity of the installation.

Exemplary flashing can, for example, be installed under a roofing membrane using mechanical fasteners, construction adhesive, or the like, or, for example, it can be installed over the roofing membrane using an adhesive flashing tape (e.g., a marginal strip that is compatible with a given roofing membrane) that overlaps both the flashing and the roofing membrane.

In exemplary embodiments of the present invention, the flashing creates a decorative edge which hides a lower edge of the installed surface material, any under structure, or drainage system for the installed surface material and roofing membrane.

It is important to note that the International Building Code requires decks, terraces, and balconies to have a guardrail if they are of a height greater than 32" off the ground. A guardrail present on rooftop patios protects the outer perimeter edge of the roof from foot traffic.

Figure 1:
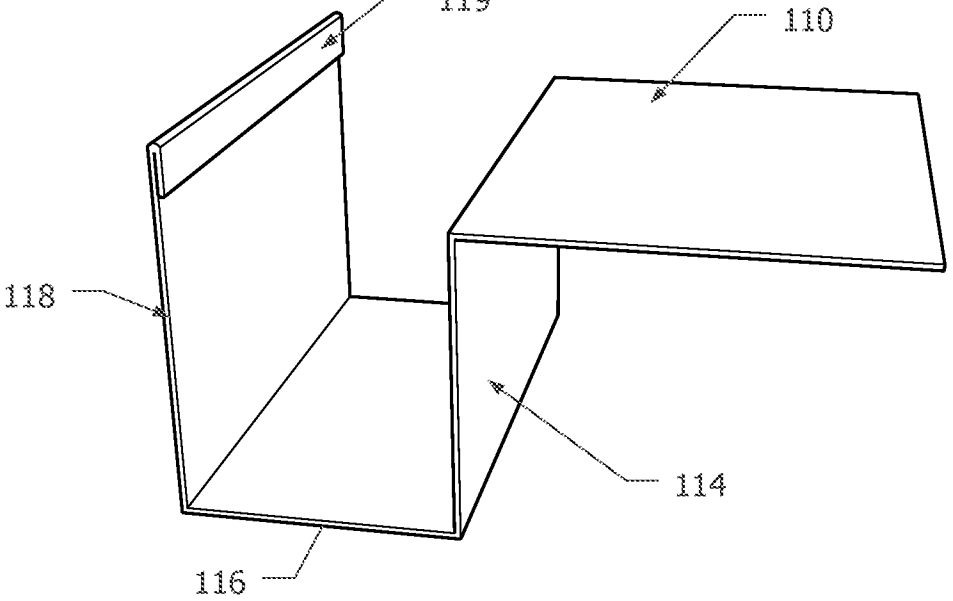
FIG. 1 shows a perspective view of a portion of an exemplary of part one of a flashing that works in tandem with proceeding variations of part two shown in FIGS. 2-17, with first horizontal leg, second inner vertical leg extending downwards, third horizontal leg, and fourth leg extending vertically upward past the plane of the first leg with an optional hem at the top.

FIG. 1 depicts a perspective view of a portion of an exemplary part one of a flashing that works in tandem with proceeding FIGS. 2-17. FIG. 1 has a horizontal leg 110, a second inner vertical leg 114 extending downwards, third horizontal leg 116, and fourth leg 118 extending vertically upward past the plane of the first horizontal leg 110 and with an optional hem 119 at the top.

Figure 2:
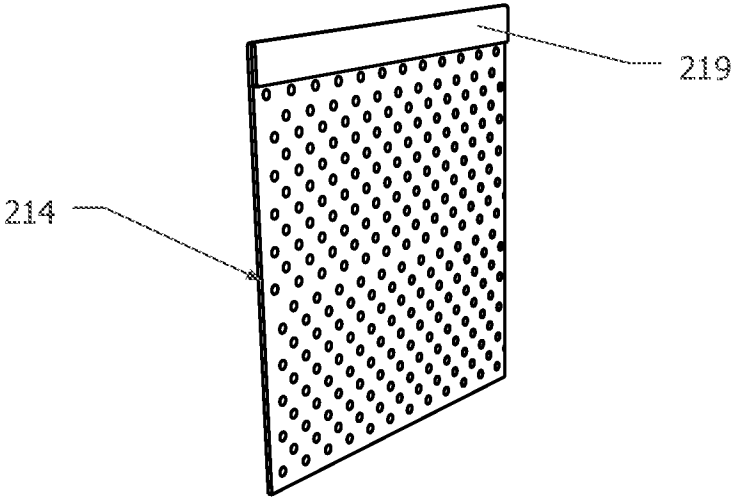
FIG. 2 shows a perspective view of a portion of an exemplary variation of a part two of a flashing, that works in tandem with part one of FIG. 1, with a vertical leg with a hem on the upper portion.

FIG. 2 depicts a perspective view of a portion of an exemplary variation of a part two of a flashing that works in tandem with part one of FIG. 1, with a vertical leg 214 with perforations 213 and a hem 219 on the upper portion.

Figure 3:
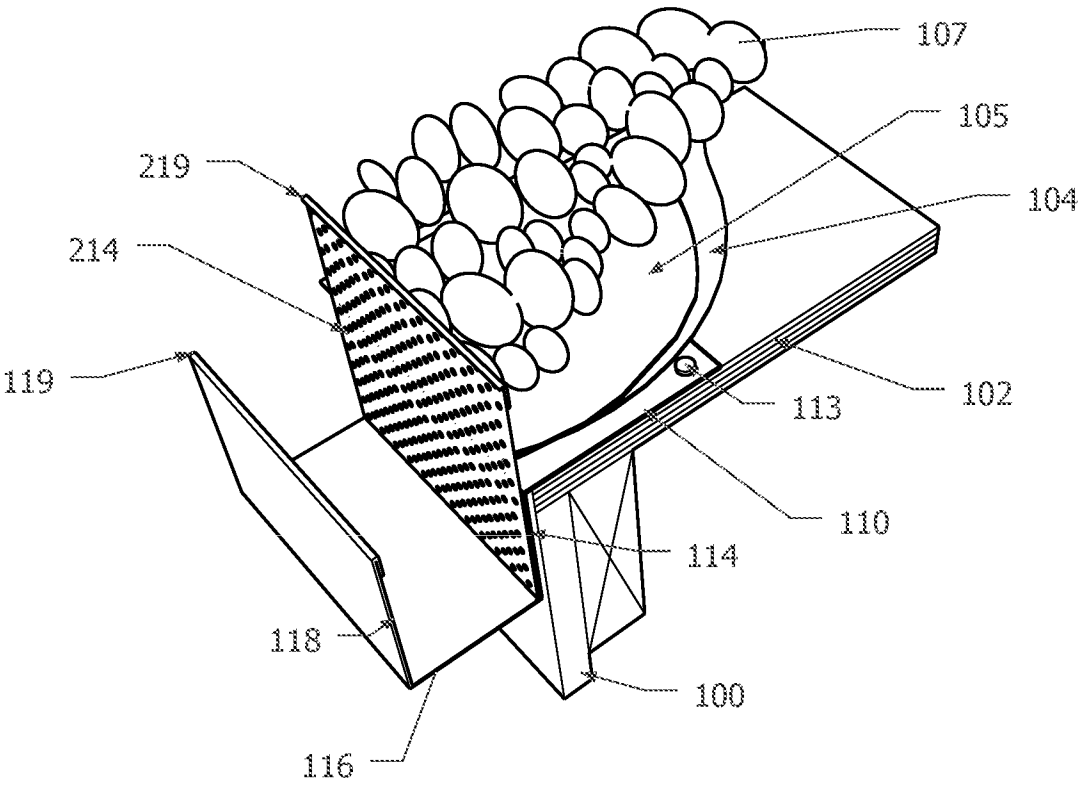
FIG. 3 shows a perspective view of a portion of an exemplary flashing comprised of part one of FIG. 1 and part two of FIG. 2 in tandem provided on a flat roof with part two extending vertically from the lower part of the inner vertical leg of part one and extending past the horizontal leg of part one creating an edge for stone ballast.

FIG. 3 shows a perspective view of a portion of an exemplary flashing comprised of part one of FIG. 1 and part two of FIG. 2 in tandem provided on a flat roof with vertical leg 214 of part two abutting and extending vertically from the lower part of the inner vertical leg 114 of part one and extending past the horizontal leg 110 of part one creating an edge with a hem 219 for stone ballast 107.

The horizontal leg 110 of part one is laid flat along the rooftop. In this embodiment, it is fastened with mechanical fasteners 113 to the roof deck (substrate) 102. An appropriate construction adhesive may be used to adhere this leg to the roof deck 102 as well. The roofing membrane, marginal strip or material 104 in this embodiment is adhered over the top of the flashing using the appropriate adhesive. An extra piece of membrane or drainage mat 105 is installed over the entire roof.

In practice, part two is attached mechanically or otherwise to at least a portion of the upper part of leg 114 of part one. Part two creates a retaining edge for applied surface material such as ballasts, green roof growing media, or pavers while allowing water to flow into the trough provided by part one.

Water is allowed to pass through the perforations 213 in vertical leg 214 into the trough formed by vertical leg 114, horizontal leg 116, and vertical leg 118 of part one, where it can be transported to an outlet such as a downspout and away from the building structure.

Figure 4:
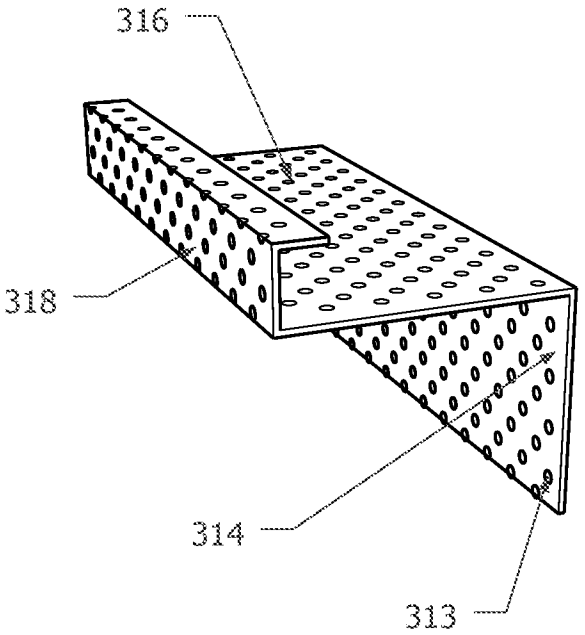
FIG. 4 shows a perspective view of a portion of an exemplary variation of a part two of a flashing that works in tandem with part one of FIG. 1, with a vertical leg, horizontal leg, vertical leg, and inward facing leg.

FIG. 4 depicts a perspective view of a portion of an exemplary variation of a part two of a flashing with perforations 313 that works in tandem with part one of FIG. 1, with a vertical leg 314 transitioning to horizontal leg 316 vertical leg and inward facing leg.

Figure 5:
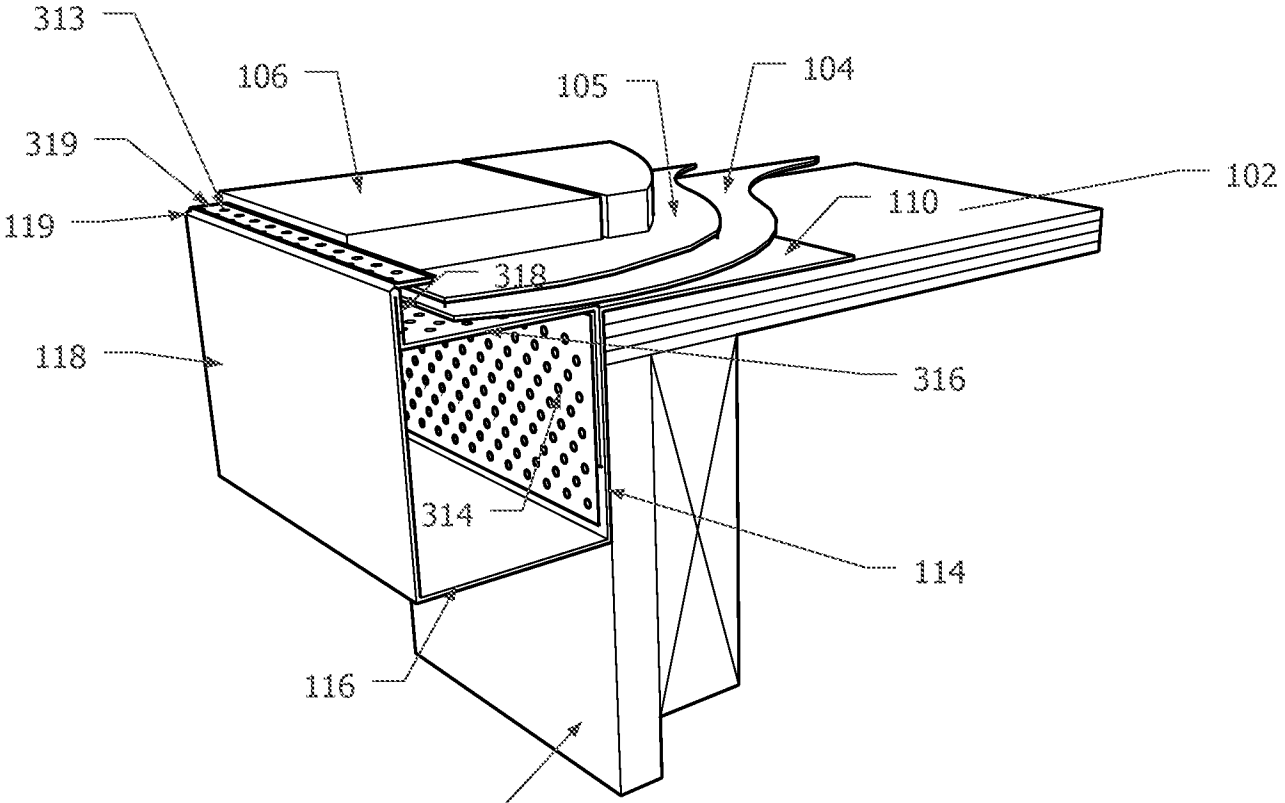
FIG. 5 shows a perspective view of a portion of an exemplary flashing comprising part one of FIG. 1 and part two of FIG. 4 in tandem provided on a flat roof with pavers installed.

FIG. 5 shows a perspective view of a portion of an exemplary flashing comprised of part one of FIG. 1 and part two of FIG. 4 in tandem provided on a flat roof and edging pavers with vertical leg 314 of part two abutting the vertical leg 114 of part one, leg 316 of part one extending horizontally across the trough of part one and being in the same plane as leg 110 or part one, leg 318 protruding upwards and abutting hem 119 on the upper portion of leg 118 of part one, leg 319 extending inwards and abutting pavers 106.

The horizontal leg 110 of part one is laid flat along the rooftop. In this embodiment, it is fastened with mechanical fasteners 113 to the roof deck (substrate) 102. An appropriate construction adhesive may be used to adhere this leg to the roof deck 102 as well. The roofing membrane, marginal strip or material 104 in this embodiment is adhered over the top of the flashing using the appropriate adhesive. An extra piece of membrane or drainage mat 105 is installed over the entire roof.

In practice, vertical leg 314 of part two need not be attached to the inner vertical leg of part one. By abutting the inner portion of horizontal leg 116 of part one it supports the downward pressure of the installed pavers 106. In instances where a guardrail protects the perimeter of the roof from foot traffic and the majority of the weight of the installed surface material or pavers 106 is over the roof deck 102, the vertical leg 318 of part two abutting the vertical leg 118 of part one may not require attachment.

Water flowing over pavers 106 is allowed to flow through perforated horizontal leg 319. Water that flows over and under pavers 106 is allowed to flow through perforated horizontal leg 316 and into the trough formed by vertical leg 114, horizontal leg 116, and vertical leg 118 of part one where it can be transported to an outlet such as a downspout and away from the building structure.

Figure 6:
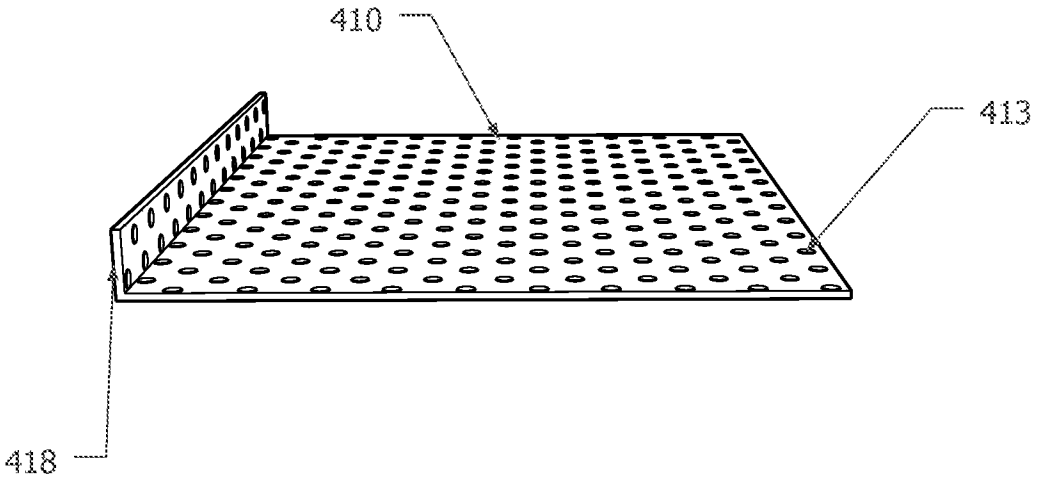
FIG. 6 shows a perspective view of a portion of an exemplary variation of a part two of a flashing that works in tandem with part one of FIG. 1, with a horizontal leg and vertical leg extending upwards.

FIG. 6 depicts a perspective view of a portion of an exemplary variation of a part two of a flashing with perforations 413 that works in tandem with part one of FIG. 1, with a horizontal leg 410 and vertical leg 418 extending upwards.

Figure 7:
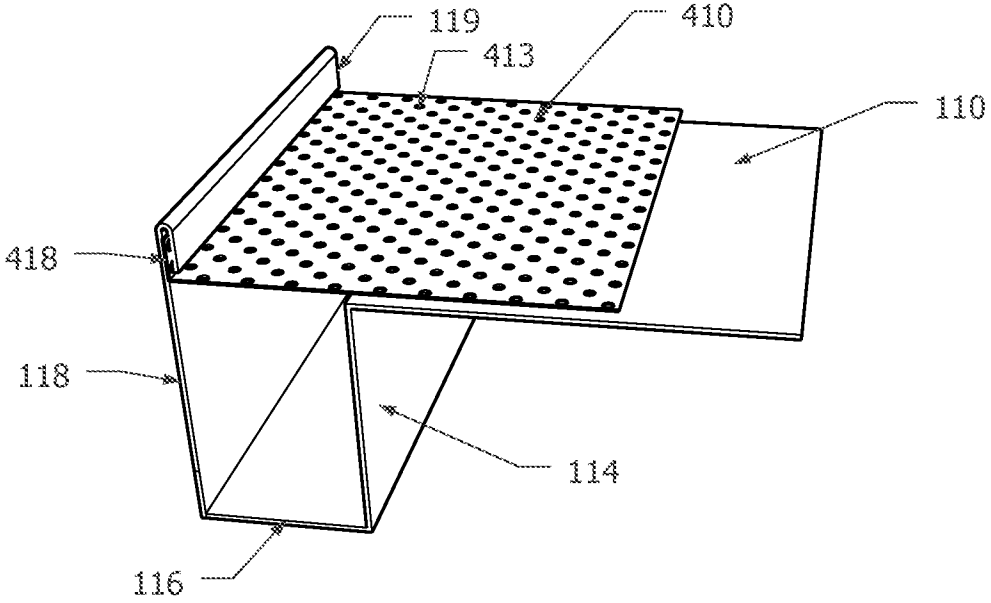
FIG. 7 shows a perspective view of a portion of an exemplary flashing comprising part one of FIG. 1 and part two of FIG. 6 in tandem.

FIG. 7 shows a perspective view of a portion of an exemplary flashing comprised of part one of FIG. 1 and part two of FIG. 6 in tandem with horizontal leg 410 of part two overlapping horizontal leg 110 of part one and extending horizontally across trough formed by vertical leg 114, horizontal leg 116, and vertical leg 118 of part one, vertical leg 418 inserted into hem 119 abutting vertical leg 118 of part one.

In practice the hem 119 of vertical leg 118 of part one provides an edging for an installed surface material while water flowing under the installed surface material is allowed to enter via perforations 413 into the trough formed by vertical leg 114, horizontal leg 116 and vertical leg 118 of part one where it can be transported to an outlet such as a downspout and away from the building structure.

Figure 8:
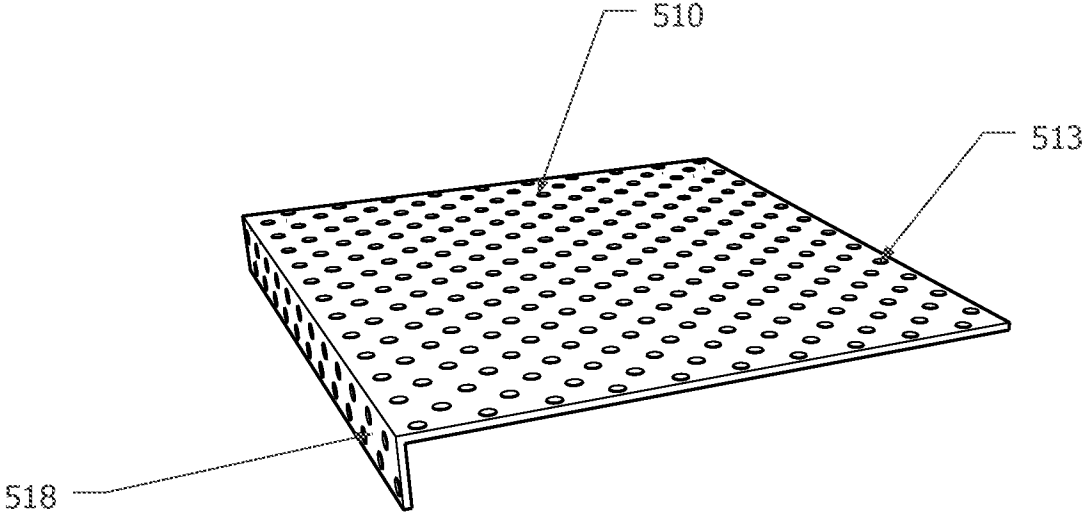
FIG. 8 shows a perspective view of a portion of an exemplary variation of a part two of a flashing that works in tandem with part one of FIG. 1, with a horizontal leg and a vertical leg extending downwards.

FIG. 8 shows a perspective view of a portion of an exemplary variation of a part two with perforations 513 of a flashing that works in tandem with part one of FIG. 1, with a horizontal leg 510 and a vertical leg 518 extending downwards.

Figure 9:
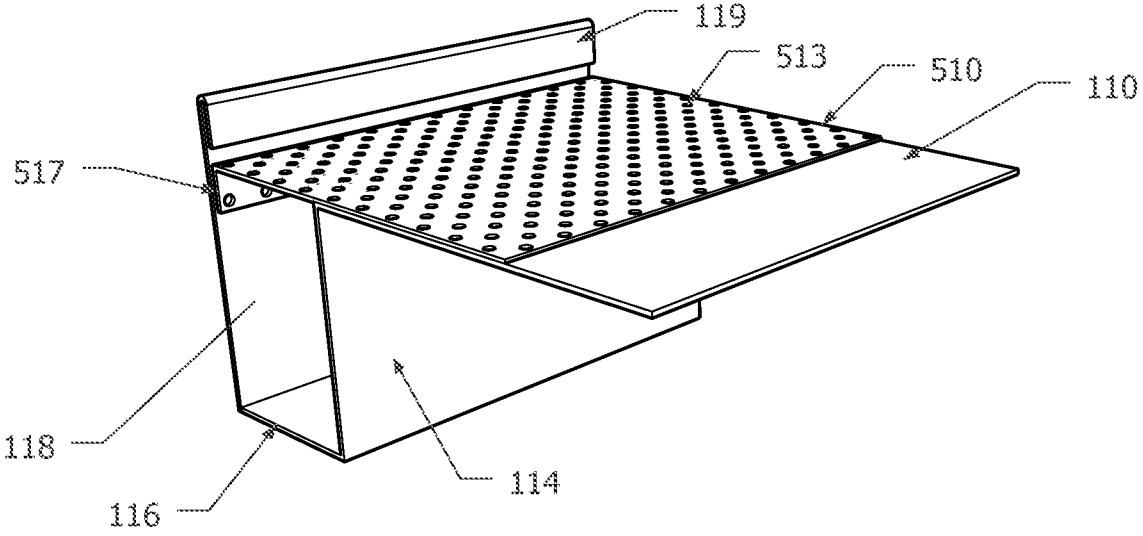
FIG. 9 is a perspective view of a portion of an exemplary flashing comprising part one of FIG. 1 and part one of FIG. 8 in tandem.

FIG. 9 is a perspective view of a portion of an exemplary flashing comprised of part one of FIG. 1 and part two of FIG. 8 in tandem with horizontal leg 510 of part two overlapping horizontal leg 110 of part one and extending horizontally across trough formed by vertical leg 114, horizontal leg 116, and vertical leg 118 of part one, vertical leg 517 extending downwards and abutting vertical leg 118 of part one.

In practice, the hem 119 of vertical leg 118 of part one provides an edging for an installed surface material while water flowing under the installed surface material is allowed to enter via perforations 513 into the trough formed by vertical leg 114, horizontal leg 116, and vertical leg 118 of part one where it can be transported to an outlet such as a downspout and away from the building structure.

Vertical leg 517 of part one can be attached to vertical leg 118 of part one. Vertical leg 517 of part two can also extend down to make contact with the leg 116 of part one enabling it to support installed surface material without being attached.

Figure 10:
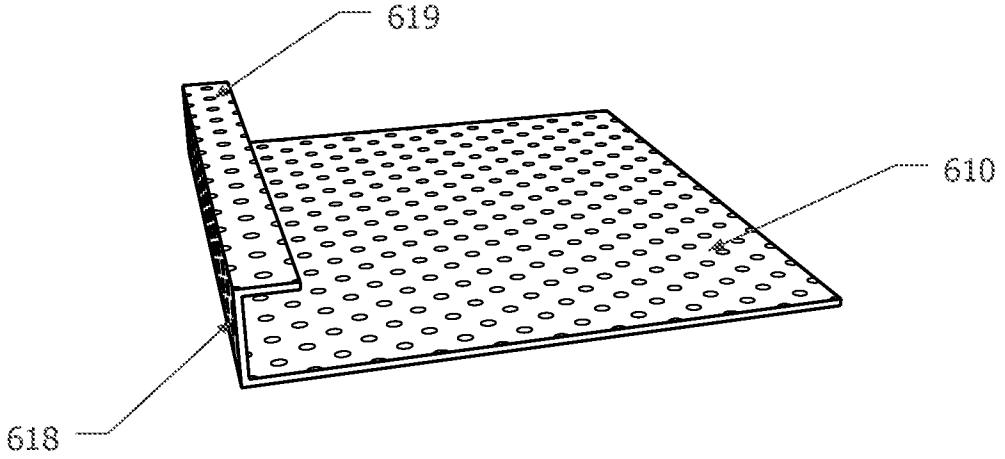
FIG. 10 is a perspective view of a portion of an exemplary variation of a part two of a flashing that works in tandem with part one of FIG. 1, with a horizontal leg, vertical leg extending upwards and a leg extending horizontally inwards.

FIG. 10 is a perspective view of a portion of an exemplary variation of a part two of a flashing that works in tandem with part one of FIG. 1, with a horizontal leg 610, with vertical leg 618 extending upwards and leg 619 extending horizontally inwards.

Figure 11:
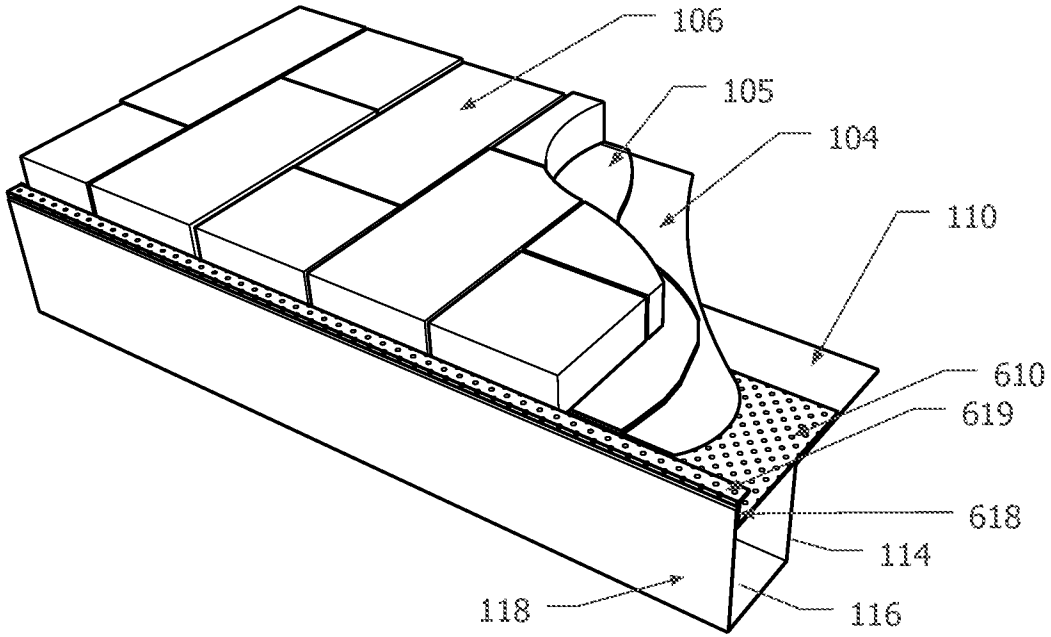
FIG. 11 is a perspective view of a portion of an exemplary flashing comprising part one of FIG. 1 and part two of FIG. 10 in tandem provided on a flat roof and edging pavers.
Figure 12:
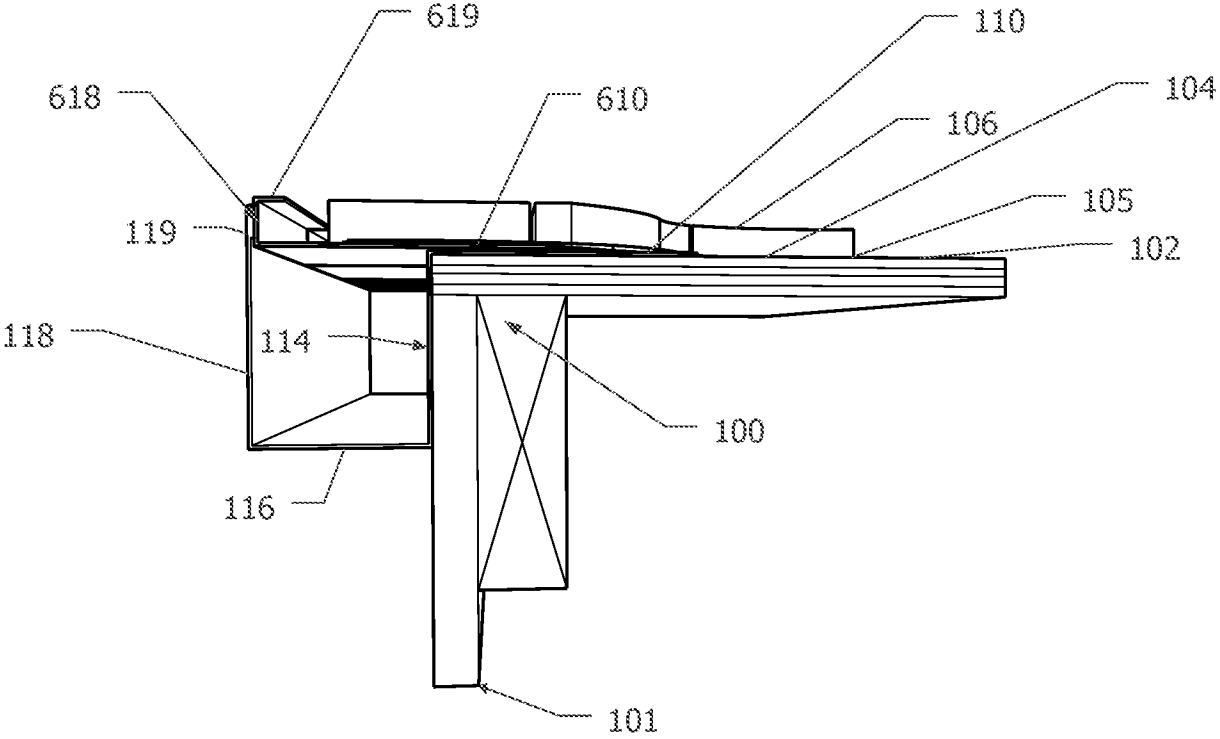
FIG. 12 shows a side view of the exemplary flashing of FIG. 11.
Figure 13:
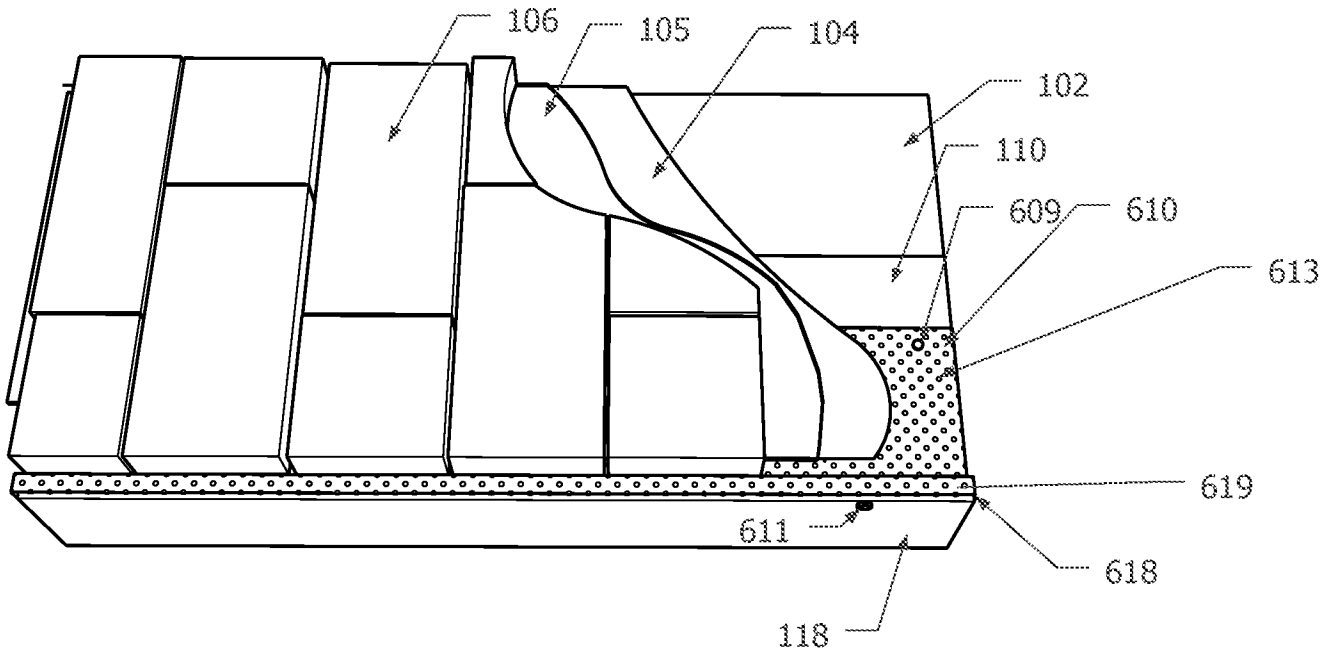
FIG. 13 is a top view of the exemplary flashing of FIG. 11.

FIGS. 11-13 (perspective, side, and top views) show an exemplary flashing comprising part one of FIG. 1 and part two of FIG. 10 in tandem provided on a flat roof and edging pavers.

Horizontal leg 110 of the flashing is installed underneath the roofing membrane or material 104 slip sheet 105 and surface material 106. Part one vertical inside leg 114, horizontal leg 116, and outside vertical leg 118 form a rectangular trough allowing for water that flows through the horizontal leg 610 of part two to exit via downspouts, scuppers, rain chains or preferred water outlets. At the same time, the outside vertical leg 118 of part one abuts and can be attached to the vertical upward leg 618 of part two, thus solidifying the assembly. Rivets 611 would be one example of an attachment method in this application.

The top of installed surface material 106 is higher then the abutting inwardly extending leg 619 of part two. Thus the assembly acts as a perimeter edging retainer abutting the surface material 106. At the same time, since part two is perforated 613, water that flows over or underneath the installed surface material is able to flow into the trough of part one and away from the roof.

Most flat roofs require a guardrail (International Residential Code requires a guardrail if a roof or deck is higher than 32" off the ground). This impedes foot traffic along the perimeter edge of the roof where surface material 106 is installed over the flashing. Surface material 106 provides a degree of protection from unwanted debris entering the trough.

Figure 14:
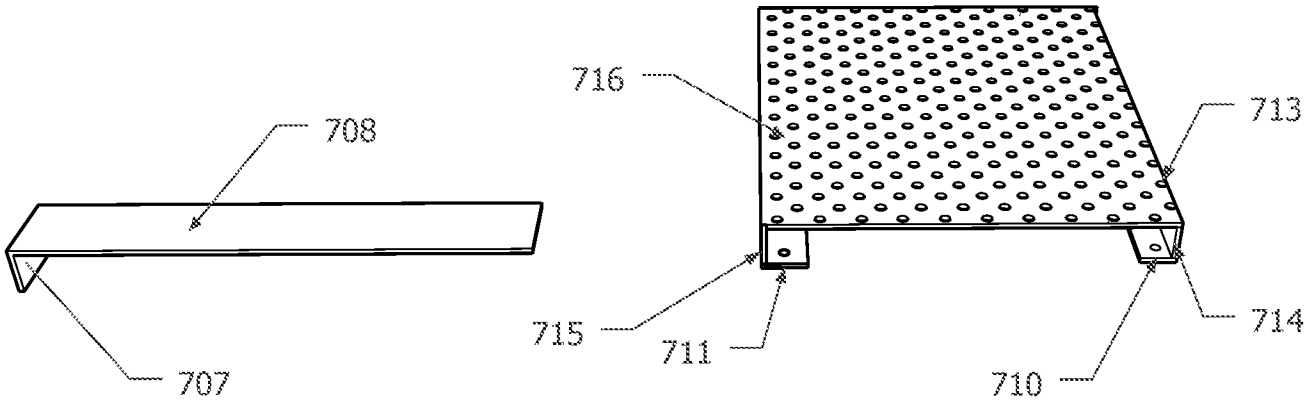
FIG. 14 is a perspective view of an L-shaped bracket and a portion of an exemplary variation of a part two of a flashing that works in tandem with part one of FIG. 1.

FIG. 14 is a perspective view of an L-shaped bracket with horizontal leg 708 and vertical leg 707 and a portion of an exemplary variation of a perforated 713 part two of a flashing that works in tandem with part one of FIG. 1, with horizontal leg 716 with symmetric vertical legs 714 and 715 extending downwards to symmetric inward facing horizontal legs 710 and 711.

Figure 15:
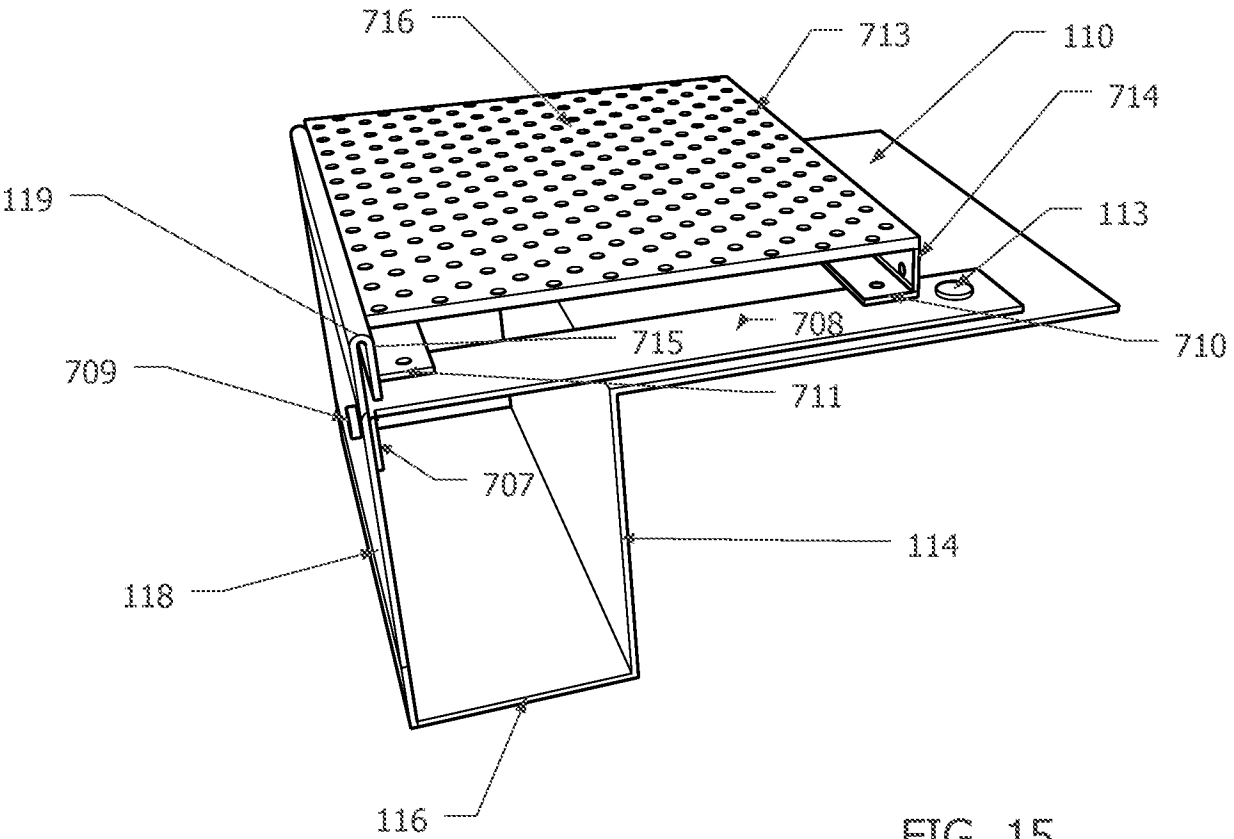
FIG. 15 is a perspective view of a portion of an exemplary flashing comprising part one of FIG. 1 and part two of FIG. 14 in tandem with the L-shaped bracket of FIG. 14.

FIG. 15 is a perspective view of a portion of an exemplary flashing comprising part one of FIG. 1 and part two of FIG. 14 in tandem with the L-shaped bracket of FIG. 14 with legs 710 and 711 of part two supported by leg 708 of the L-shaped strap. Leg 707 of the L-shaped strap is attached to the roof deck (not shown) by a fastener 113 and by rivet 709 to the vertical leg 118 of part one. The hem 119 located at the top of vertical leg 118 of part one abuts the vertical leg 715 of part two.

In practice, vertical leg 714 of part two provides an edging surface for an applied surface material (not shown). Vertical leg 714 and horizontal leg 716 allow water to enter via perforations 713 into the trough formed by vertical leg 114, horizontal leg 116, and vertical leg 118 of part one where it can be transported to an outlet such as a downspout and away from the building structure.

Part two is removable which makes cleaning easier. It also provides an edging that can be installed over the roof structure when it's necessary that installed surface material not extend out from the roof structure.

Figure 16:
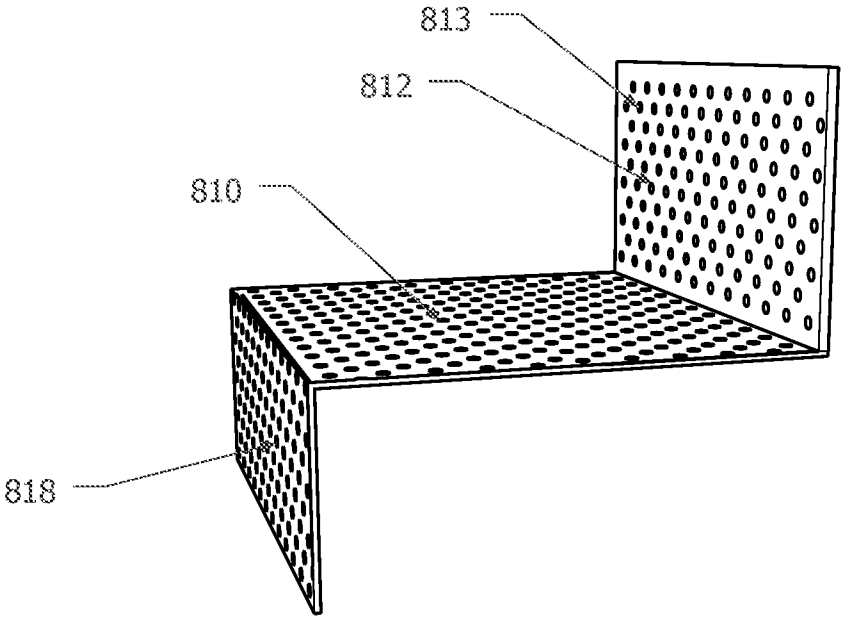
FIG. 16 is a perspective view of a portion of an exemplary variation of a part two of a flashing that works in tandem with part one of FIG. 1, with a horizontal leg with a vertical leg extending down from one side and a vertical leg extending upwards on the other side.

FIG. 16 is a perspective view of a portion of an exemplary variation of a perforated 813 part two of a flashing that works in tandem with part one of FIG. 1, with a horizontal leg 810 with a vertical leg 818 extending down from one side and a vertical leg 812 extending upwards on the other side.

Figure 17:
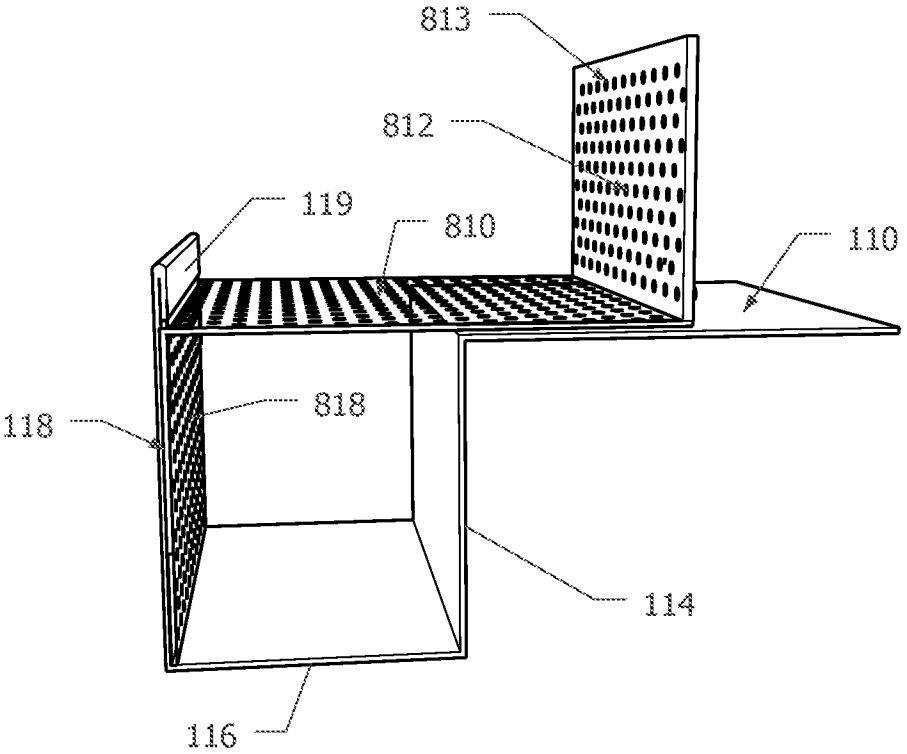
FIG. 17 is a perspective view of a portion of an exemplary flashing comprising part one of FIG. 1 and part two of FIG. 16 in tandem.

FIG. 17 is a perspective view of a portion of an exemplary flashing comprised of part one of FIG. 1 and part two of FIG. 16 in tandem with horizontal leg 810 of part two overlapping horizontal leg 110 of part one and spanning the trough formed by vertical leg 114, horizontal leg 116, and vertical leg 118 of part one, leg 818 extending down and abutting vertical leg 118 of part one, leg 812 extending up and providing an edging for flat roof patios and green roofs.

In practice, a porous drainage trough is created by vertical leg 118 of part one (which could extend higher then shown) and perforated 813 leg 810 and 812 (stone ballast or other media not shown could be installed). Water would be allowed to flow into the trough formed by vertical leg 114, horizontal leg 116, and vertical leg 118 of part one where it can be transported to an outlet such as a downspout and away from the building structure.

In other applications, the flashing can be installed over the roofing membrane instead of underneath it. In such cases, larger holes can be located towards the inner edge of the horizontal leg. These larger holes would augment adhesion of the sandwiched horizontal leg of flashing along the perimeter where the lower roofing membrane and upper slip sheet of roofing membrane may be adhered. Another method of fastening the flashing can be the use of a compatible adhesive flashing tape to adhere the flashing to the lower sheet of roofing membrane.

Other shapes including curved shapes could be incorporated into the design of the flashing.

The flashing can be made out of many different materials preferably resistant to rust or decay. Such materials could include, but wouldn't be limited to, coated (finished, painted) steel or aluminum, copper, stainless steel, plastics, and composites. Any color would be possible, making the flashing a complimentary color accent to homes, buildings, and terraces.

The scope of the embodiments should be determined by the appended claims and their legal equivalents, rather than by examples given.

Thus the reader will see that at least one embodiment of the edge flashing for flat roofs provides significant improvements over past devices.

While the above description contains many specificities, these specificities should not be construed as limitations to the scope, but rather as an exemplification of several preferred embodiments thereof. Many other variations are possible.

The invention claimed is:

1. A combination flashing for rooftop patios or green roofs, comprising:

a trough with:

a first horizontal planar portion configured to, in use, be substantially affixed to at least a portion of a roof material or roof deck, a second planar portion protruding downwards from an edge of the first horizontal planar portion, and being substantially perpendicular to the first horizontal planar portion, a third planar portion protruding outwards from a bottom edge of the second planar portion, and a fourth planar portion protruding upwards from an outer edge of the third planar portion extending past a horizontal plane of the first planar portion and a top edge of the fourth planar portion forming a hem at the top of the fourth planar portion, the second, third and fourth planar portions creating a U-shaped trough; and a perforated cover with:

a fifth horizontal planar portion, and a sixth planar portion protruding upwards from the edge of the fifth portion, and being substantially perpendicular to the fifth planar portion, the sixth planar portion having a top edge, the top edge configured to reside within the hem formed by the top edge of the fourth planar portion of the trough.

2. The combination flashing of claim 1, wherein the flashing is made of metal.

3. The combination flashing of claim 1, wherein the perforated cover abuts a portion of the inside of the fourth planar portion of the trough.

4. The combination flashing of claim 1, wherein the perforated cover overlaps a portion of the first horizontal planar portion of the trough.

* * * * *